US006626107B2

(12) United States Patent
Fuseki et al.

(10) Patent No.: US 6,626,107 B2
(45) Date of Patent: Sep. 30, 2003

(54) CLEANING APPARATUS AND METHOD OF DETECTING CATCHING OF CLEANING WEB IN THE SAME

(75) Inventors: Takashi Fuseki, Ibaraki (JP); Yasuo Kato, Ibaraki (JP)

(73) Assignee: Komori Corporation, Tokyo (JP)

( * ) Notice: Subject to any disclaimer, the term of this patent is extended or adjusted under 35 U.S.C. 154(b) by 25 days.

(21) Appl. No.: 09/882,631

(22) Filed: Jun. 15, 2001

(65) Prior Publication Data

US 2002/0000168 A1 Jan. 3, 2002

(30) Foreign Application Priority Data

Jun. 22, 2000 (JP) ..... 2000-188316

(51) Int. Cl.[7] ..... B41L 41/00
(52) U.S. Cl. ..... 101/425; 101/423
(58) Field of Search ..... 101/425, 423, 101/424; 15/256.51, 256.52; 400/249

(56) References Cited

U.S. PATENT DOCUMENTS

| | | | | |
|---|---|---|---|---|
| 5,290,114 A | * | 3/1994 | Asami et al. | 400/249 |
| 5,326,182 A | * | 7/1994 | Hagstrom | 400/249 |
| 5,333,960 A | * | 8/1994 | Nam | 400/249 |
| 5,727,470 A | | 3/1998 | Kurzer et al. | |
| 5,797,325 A | * | 8/1998 | Ebina et al. | 101/425 |
| 5,964,007 A | * | 10/1999 | Wisniewski et al. | 101/425 |

FOREIGN PATENT DOCUMENTS

| | | |
|---|---|---|
| DE | 29611014 | * 8/1996 |
| EP | 0291745 | 11/1988 |
| EP | 0552856 | 7/1993 |
| JP | 0307036 | * 11/1992 |

* cited by examiner

*Primary Examiner*—Andrew H. Hirshfeld
*Assistant Examiner*—Anthony H. Nguyen
(74) *Attorney, Agent, or Firm*—Blakely, Sokoloff, Taylor & Zafman

(57) ABSTRACT

A cleaning apparatus includes a cleaning cloth, supply shaft, take-up shaft, detector, projections, proximity switch, and catching detection unit. The cleaning cloth is pressed against a rotary member and cleans an outer surface of the rotary member. The cleaning web before cleaning is wound around the supply shaft. The supply shaft rotates in accordance with supply operation of the cleaning cloth to the outer surface of the rotary member. The take-up shaft is rotatably driven to take up the cleaning cloth supplied from the supply shaft to the outer surface of the rotary member. The detector, projections, and proximity switch output a signal corresponding to a rotational speed of the supply shaft. The catching detection unit detects that the cleaning cloth is caught in the rotary member on the basis of a state of the signal output from the detector, projections, and proximity switch. A method of detecting catching of the cleaning web in the cleaning apparatus is also disclosed.

10 Claims, 8 Drawing Sheets

FIG.2A
TIMER
FIG.2B
ROTATION SIGNAL
FIG.2C
DETECTION SIGNAL
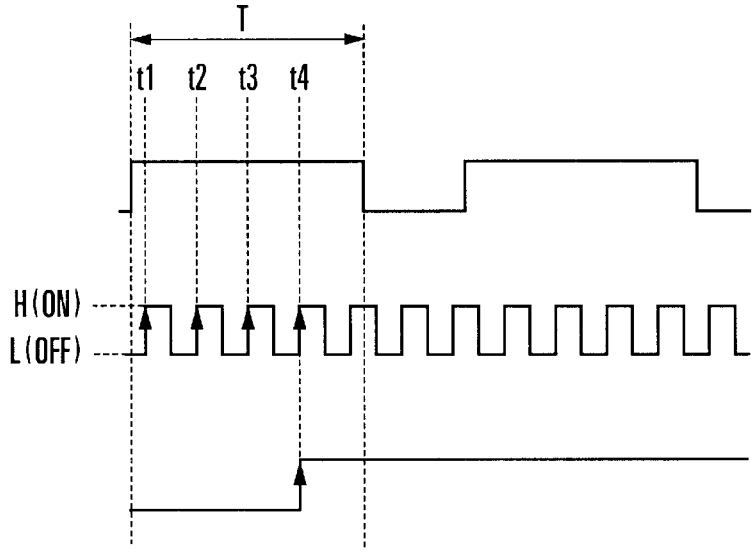
FIG.3A
ROTATION SIGNAL
FIG.3B
DETECTION SIGNAL
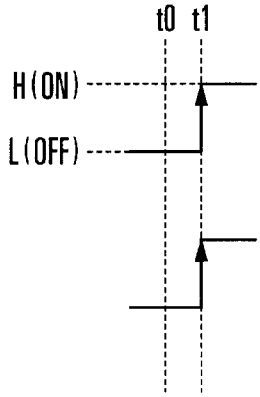
FIG.4A
ROTATION SIGNAL
FIG.4B
DETECTION SIGNAL
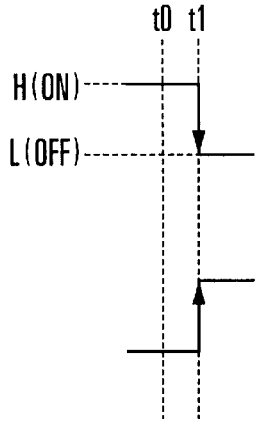

FIG.5A
ROTATION SIGNAL
FIG.5B
TIMER
FIG.5C
DETECTION SIGNAL
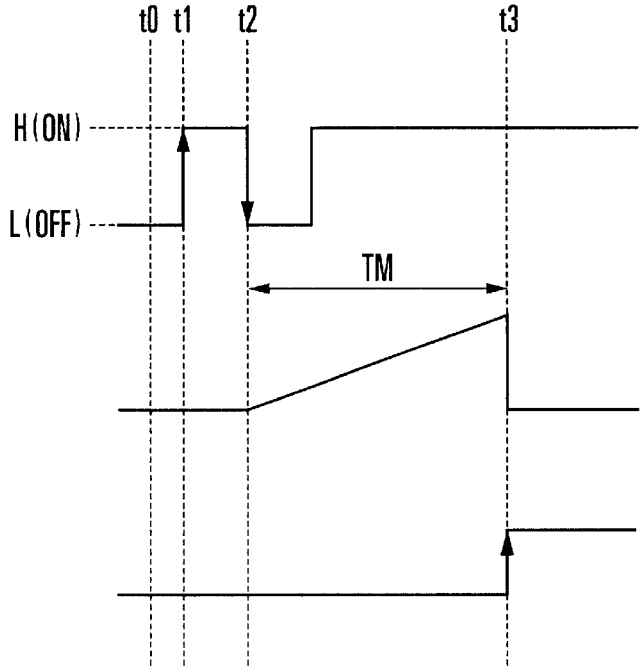
FIG.6A
ROTATION SIGNAL
FIG.6B
TIMER
FIG.6C
DETECTION SIGNAL
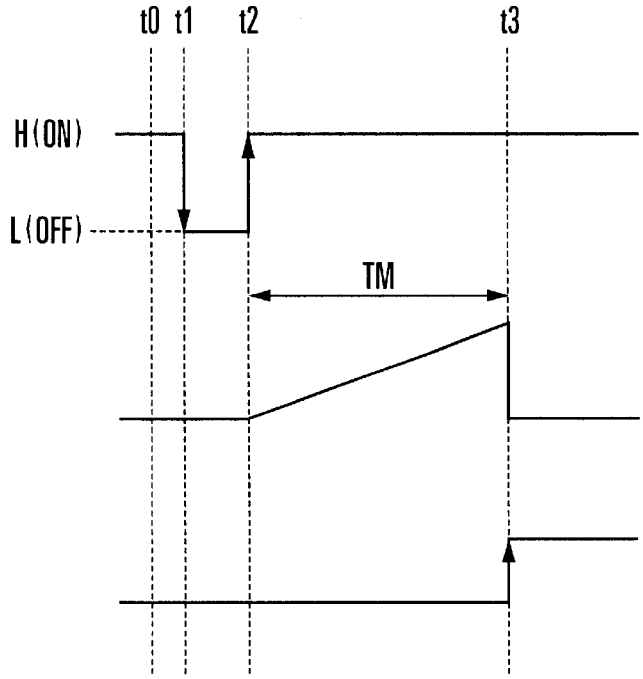

CLEANING APPARATUS AND METHOD OF DETECTING CATCHING OF CLEANING WEB IN THE SAME

BACKGROUND OF THE INVENTION

The present invention relates to a cleaning apparatus for cleaning an outer surface of a rotary member by pressing a cleaning web against it and, more particularly, to a catching detecting method and unit in the cleaning apparatus which detect that a cleaning web is caught in a rotary member.

In general, a printing press has a cleaning apparatus for cleaning the outer surface of a cylinder serving as a rotary member by urging a belt-like cleaning cloth against it. EP 0552856 (reference 1) discloses a cleaning apparatus of this type, the main part of which is shown in FIG. 11. Referring to FIG. 11, reference numeral 1 denotes the blanket cylinder of the printing press. A supply shaft 2 supplies a belt-like cleaning cloth 6. A take-up shaft 3 takes up the cleaning cloth 6. Guide rollers 4 and 5 guide the cleaning cloth 6 to the outer surface of the blanket cylinder 1. A lever 8 is axially supported by a support pin 7 and detects that the cleaning cloth 6 is caught. A tension spring 11 has two ends respectively fixed by spring catches 9 and 10. A limit switch 12 is actuated by the lever 8.

The take-up shaft 3 intermittently takes up the cleaning cloth 6 supplied from the supply shaft 2 through the guide rollers 4 and 5. In this cleaning apparatus, the cleaning cloth 6 intermittently traveling between the supply shaft 2 and take-up shaft 3 is pressed against the rotating blanket cylinder 1 in a taught state, so the outer surface of the blanket cylinder 1 is cleaned with it. At this time, since the blanket cylinder 1 is rotating, the cleaning cloth 6 might be caught in the blanket cylinder 1 during cleaning. In other words, the cleaning cloth 6 may adhesively attach to the blanket surface of the blanket cylinder 1 due to the viscosity of the ink, or may be torn up by some causes, so the cleaning cloth 6 is accidentally caught in the rotating blanket cylinder 1.

In this case, in a conventional cleaning apparatus, the accident in which the cleaning cloth 6 is caught is detected in the following manner. When the cleaning cloth 6 is not caught, a distal end 8*b* of the lever 8 is pressed by the traveling cleaning cloth 6 because of the biasing force of the tension spring 11, and the limit switch 12 is set in the non-operative state. When the cleaning cloth 6 is caught, the cleaning cloth 6 is loosened, so the lever 8 is rotated clockwise in FIG. 11 by the biasing force of the tension spring 11. A distal end 8*b* of the lever 8 then presses an actuator 12*a* of the limit switch 12 to turn on an internal contact.

In the above cleaning apparatus, the limit switch 12 detects that the lever 8 swings in accordance with a change in tension of the cleaning cloth 6. Hence, when the cleaning cloth 6 is caught, if the tension of the cleaning cloth 6 does not change, accidental catching of the cleaning cloth 6 cannot be detected.

SUMMARY OF THE INVENTION

It is an object of the present invention to provide a cleaning apparatus which can reliably detect catching of a cleaning cloth even if the tension of the cleaning cloth does not change, and a method of detecting catching of the cleaning web in this apparatus.

In order to achieve the above object, according to the present invention, there is provided a cleaning apparatus comprising a cleaning web pressed against a rotary member and adapted to clean an outer surface of the rotary member, a supply shaft around which the cleaning web before cleaning is wound and which rotates in accordance with supply operation of the cleaning web to the outer surface of the rotary member, a take-up shaft rotatably driven to take up the cleaning web supplied from the supply shaft to the outer surface of the rotary member, signal output means for outputting a signal corresponding to a rotational speed of the supply shaft, and detection means for detecting that the cleaning web is caught in the rotary member on the basis of a state of the signal output from the signal output means.

BRIEF DESCRIPTION OF THE DRAWINGS

FIGS. 2A to 2C are timing charts showing the principle of catching detection during cleaning by the catching detection apparatus shown in FIG. 1A;

FIGS. 3A and 3B are timing charts showing the principle of catching detection I during non-cleaning by the catching detection apparatus shown in FIG. 1A;

FIGS. 4A and 4B are timing charts showing the principle of catching detection I during non-cleaning by the catching detection apparatus shown in FIG. 1A;

FIGS. 5A to 5C are timing charts showing the principle of catching detection II during non-cleaning by the catching detection apparatus shown in FIG. 1A;

FIGS. 6A to 6C are timing charts showing the principle of catching detection II during non-cleaning by the catching detection apparatus shown in FIG. 1A;

DESCRIPTION OF THE PREFERRED EMBODIMENT

The present invention will be described in detail with reference to the accompanying drawings.

Figure 1A:
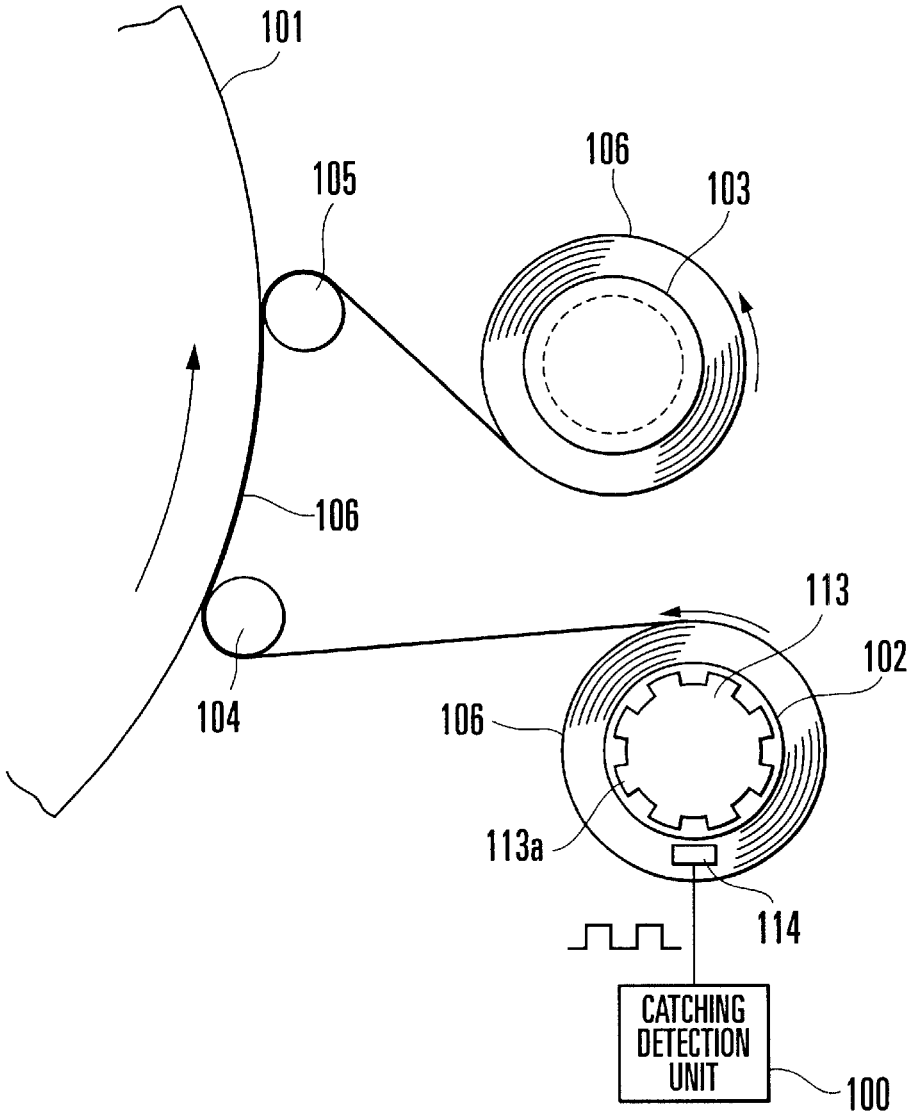
FIG. 1A is a side view showing the main part of a cleaning apparatus according to an embodiment of the present invention.

FIG. 1A shows the main part of a cleaning apparatus according to an embodiment of the present invention. Referring to FIG. 1A, reference numeral 101 denotes a blanket cylinder of a printing press. A supply shaft 102 supplies a belt-like cleaning cloth 106 as a cleaning web. A take-up shaft 103 takes up the cleaning cloth 106. Guide rollers 104 and 105 guide the cleaning cloth 106 to the outer surface of the blanket cylinder 101. The take-up shaft 103 is intermittently pivoted by a ratchet mechanism so as to take up the cleaning cloth 106 supplied from the supply shaft 102 through the guide rollers 104 and 105. At this time, the cleaning cloth 106 intermittently traveling between the supply shaft 102 and take-up shaft 103 is pressed against the rotating blanket cylinder 101 in a taut state, so the outer surface of the blanket cylinder 101 is cleaned with it. The supply shaft 102 is pivoted by the tension of the cleaning cloth 106 supplied to the outer surface of the blanket cylinder 101 as the take-up shaft 103 pivots.

Figure 1B:
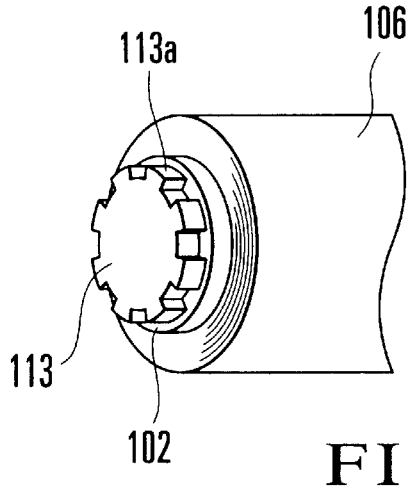
FIG. 1B is an enlarged perspective view of the detector shown in FIG. 1A.

The supply shaft 102 has a cylindrical detector 113 projecting from its one shaft end, as shown in FIG. 1B. The detector 113 is rotated together with the supply shaft 102. The detector 113 has eight magnetic metal projections 113*a* arranged equidistantly on its circumference and extending in the axial direction. A proximity switch 114 for magnetically detecting the projections 113*a* of the detector 113 as they pass is disposed to oppose the outer surface of the detector 113. During rotation of the supply shaft 102, the proximity switch 114 is ON while a projection 113*a* passes to output an "H"-level signal, and is OFF while the next projection 113*a* passes to output an "L"-level signal. In other words, the proximity switch 114 outputs a pulsed rotation signal, the output state of which alternately changes between "H" level and "L" level, to a catching detection unit 100 in accordance with rotation of the supply shaft 102.

[Catching Detection During Cleaning]

In the cleaning apparatus with the above arrangement, abnormal travel of the cleaning cloth 106 during cleaning operation, which is caused by accidental catching or the like, is detected on the basis of the output state of the rotation signal supplied from the proximity switch 114. More specifically, when the cleaning cloth 106 is caught in the blanket cylinder 101, the supply shaft 102 rotates at a speed faster than that during normal cleaning as it is pulled by the caught cleaning cloth 106. As the rotational speed of the supply shaft 102 increases, the number of output pulses from the proximity switch 114 within a predetermined period of time also increases.

The catching detection unit 100 counts the pulses of the rotation signal supplied from the proximity switch 114. When the pulse count exceeds a preset value within a predetermined period of time, i.e., when the rotational speed of the supply shaft 2 exceeds a predetermined value, the catching detection unit 100 determines that the cleaning cloth 106 is caught in the blanket cylinder 101.

In the above example, whether the cleaning cloth 106 is caught is checked by counting the output pulses within the predetermined period of time. Alternatively, the catching detection unit 100 may determine that the cleaning cloth 106 is caught in the blanket cylinder 101 when the frequency of the rotation signal exceeds a predetermined frequency at least once or continuously for a predetermined period of time. When the cleaning cloth 106 is caught in the blanket cylinder 101, the rotational speed of the supply shaft 102 increases, and the frequency of the rotation signal also increases. Hence, a traveling trouble of the cleaning cloth 106 caused when the cleaning cloth 106 is caught in the blanket cylinder 101 can be detected in the same manner by checking whether or not the frequency of the rotation signal exceeds the predetermined value.

FIGS. 2A to 2C show timing charts for detecting catching during cleaning operation. As shown in FIGS. 2A and 2B, the number of times the rotation signal from the proximity switch 114 rises to "H" level, i.e., the number of times the proximity switch 114 is turned on, within a predetermined period of time T counted by the timer is counted. When this count becomes 4 or more during the predetermined period of time T, an "H"-level detection signal indicating that the cleaning cloth 106 is caught in the blanket cylinder 101 is output, as shown in FIG. 2C.

[Catching Detection I During Non-Cleaning (Wait Mode After Cleaning Is Ended)]

Catching of the cleaning cloth 106 during non-cleaning operation is also detected on the basis of the output state of the rotation signal supplied from the proximity switch 114. More specifically, when cleaning operation is ended, take-up operation for the cleaning cloth 106 by the take-up shaft 103 is stopped, and the cleaning cloth 106 is separated from the outer surface of the blanket cylinder 101. At this time, during a state wherein the printing press keeps operation, i.e., in the wait mode in a state wherein the blanket cylinder 101 is kept rotating, the cleaning cloth 106 is accidentally caught in the blanket cylinder 101 by some cause.

As a countermeasure for this, the output state ("H" or "L" level) of the rotation signal from the proximity switch 114 is stored with the supply shaft 102 being stopped at the end of cleaning. The stored output state of the rotation signal and the output state of the rotation signal in the wait mode are compared. If the output states differ, it is determined that the cleaning cloth 106 is caught in the blanket cylinder 101.

FIGS. 3A and 3B, and FIGS. 4A and 4B show timing charts of catching detection I during non-cleaning operation. FIG. 3A shows a case wherein the rotation signal is at "L" level at time t0 at the end of cleaning, i.e., a case wherein the proximity switch 114 is OFF and the supply shaft 102 is stopped. FIG. 4A shows a case wherein the rotation signal is at "H" level at time t0 at the end of cleaning, i.e., a case wherein the proximity switch 114 is ON and the supply shaft 102 is stopped.

As shown in FIG. 3A, in the wait mode after cleaning is ended, when the cleaning cloth 106 is caught in the blanket cylinder 101, the supply shaft 102 pivots, and the rotation signal from the proximity switch 114 becomes "H" level at time t0. In this case, since the signal level in the wait mode changes from the one (storage level) obtained at the end of cleaning, an "H"-level detection signal is output, as shown in FIG. 3B.

As shown in FIG. 4A, in the wait mode after cleaning is ended, when the cleaning cloth 106 is caught in the blanket cylinder 101, the supply shaft 102 pivots, and the rotation signal from the proximity switch 114 becomes "L" level at time t1. In this case, since the signal level in the wait mode changes from the one (storage level) obtained at the end of cleaning, an "H"-level detection signal is output, as shown in FIG. 4B.

[Catching Detection II During Non-Cleaning (Wait Mode After Cleaning Is Ended)]

Catching detection operation I is subject to erroneous detection due to vibration or impact. More specifically, when the output state of the rotation signal from the proximity switch 114 at the end of cleaning changes only once, it is determined that catching occurs. For example, when the supply shaft 102 is kept stopped at the boundary between ON and OFF of the proximity switch 114 and pivots slightly due to vibration or impact, so the proximity switch 114 changes from the ON state to the OFF state, or from the OFF state to the ON state, a catching detection signal is erroneously output.

In order to avoid such erroneous detection, the output state ("H" or "L" level) of the rotation signal from the supply shaft 102 while the supply shaft 102 is kept stopped at the end of cleaning is stored. After that, when the output state of the rotation signal changes, the time point at which the output state, after having changed once, is restored to the initial output state obtained at the end of cleaning is set as the origin. Then, whether or not the supply shaft 102 is caught in the blanket cylinder 101 is checked on the basis of the output state of the rotation signal obtained at a lapse of a predetermined period of time from the preset origin.

FIGS. 5A to 5C, and FIGS. 6A to 6C show timing charts of catching detection II during non-cleaning operation. FIG. 5A shows a case wherein the rotation signal is at "L" level at time t0 at the end of cleaning, i.e., a case wherein the proximity switch 114 is OFF and the supply shaft 102 is stopped. FIG. 6A shows a case wherein the rotation signal is at "H" level at time t0 at the end of cleaning, i.e., a case wherein the proximity switch 114 is ON and the supply shaft 102 is stopped.

As shown in FIG. 5A, in the wait mode after cleaning is ended, after the rotation signal from the proximity switch 114 changes from "L" level to "H" level once at time t1, when it is restored at time t2 to "L" level (storage level) equal to the output state at the end of cleaning, time t2 is set as the origin. Then, as shown in FIG. 5B, when a predetermined period of time TM (e.g., 100 msec) has elapsed from time t2 as the origin, whether or not the output state of the rotation signal is "H" level is checked. If the output state of the rotation signal is "H" level at time t2, an "H"-level detection signal indicating that the cleaning cloth 106 is caught in the blanket cylinder 101 is output, as shown in FIG. 5C.

As shown in FIG. 6A, in the wait mode after cleaning is ended, after the rotation signal from the proximity switch 114 changes from "H" level to "L" level once at time t1, when it is restored at time t2 to "H" level (storage level) equal to the output state at the end of cleaning, time t2 is set as the origin. Then, as shown in FIG. 6B, when a predetermined period of time TM (e.g., 100 msec) has elapsed from time t2 as the origin, whether or not the output state of the rotation signal is "H" level is checked. If the output state of the rotation signal is "H" level at time t2, an "H"-level detection signal indicating that the cleaning cloth 106 is caught in the blanket cylinder 101 is output, as shown in FIG. 6C.

The "H" level at a lapse of the predetermined period of time TM from time t2 is checked, because the speed at which the cleaning cloth 106 is caught is fast and the rotation signal does not form a pulse signal due to the input-response speed of the proximity switch 114. More specifically, when the cleaning cloth 106 is caught at a high speed, the rotation signal from the proximity switch 114 at first repeats level change between "H" and "L" and then readily stays at "H" level. For this reason, in FIGS. 5A to 5C and FIGS. 6A to 6C, the level of the rotation signal at a lapse of the predetermined period of time TM from time t2 is checked, and when the rotation signal is "H" level, it is determined that catching has occurred.

In FIG. 6A, when the supply shaft 102 slightly rotates at time t1 due to vibration or impact, the rotation signal from the proximity switch 114 changes from "H" level to "L" level, and the supply shaft 102 that has rotated slightly is sometimes restored to the initial state. In this case as well, counting of the predetermined period of time TM is started with respect to the time point, at which the rotation signal from the proximity switch 114 changes to "H" level after having changed from "L" level to "H" level, as the origin. As the level of the rotation signal at a lapse of the predetermined period of time TM is "H" level, an erroneous catching detection signal is output.

In order so solve this problem, the supply shaft 102 may constantly be lightly braked, so if it has rotated slightly due to vibration or impact, it will not be easily restored to the initial state. Then, the supply shaft 102 that has rotated slightly due to vibration or impact is not restored to the initial state, and no erroneous signal is output.

Figure 7:
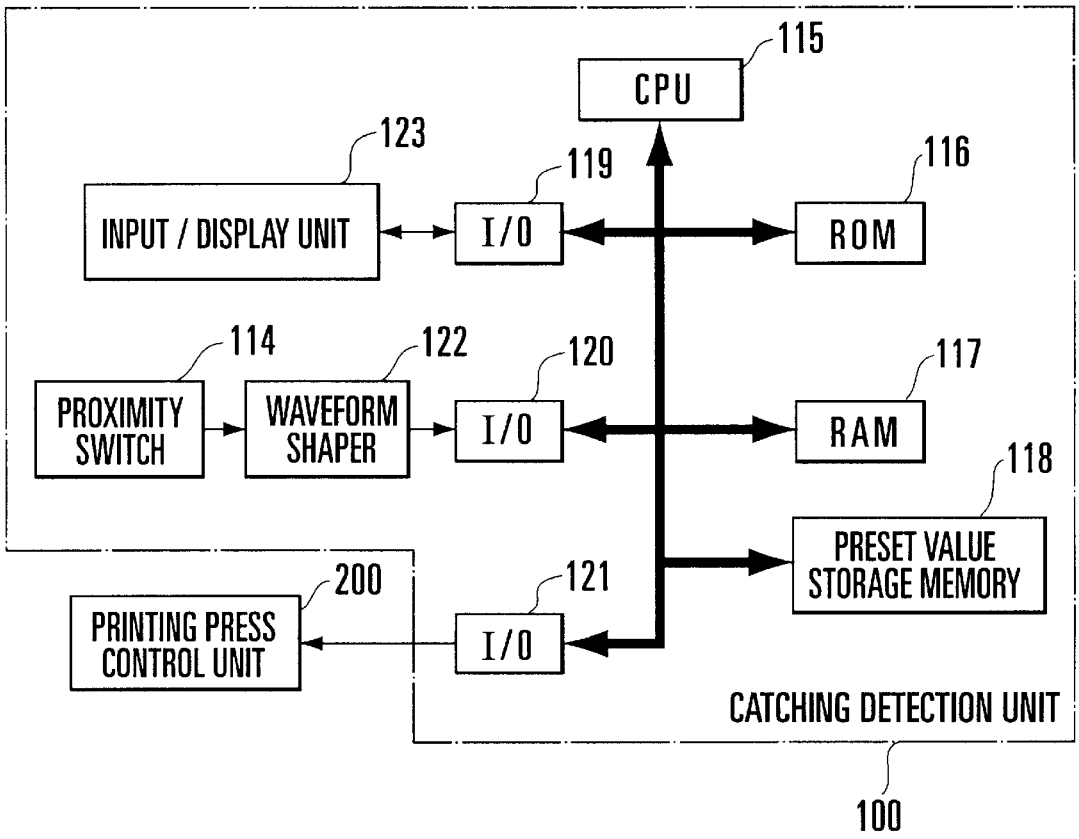
FIG. 7 is a block diagram of the catching detection apparatus shown in FIG. 1A.

FIG. 7 shows a catching detection unit 100 which performs catching detection in accordance with the principle described above. The catching detection unit 100 has the proximity switch 114 described above, a CPU (Central Processing Unit) 115 for performing a catching detection process, a ROM (Read Only Memory) 116 storing a catching detection program, a RAM (Random Access Memory) 117, a preset value storage memory 118 for storing a preset value A required when performing catching detection during cleaning, interfaces (I/Os) 119 to 121 for performing various types of interface operations, a waveform shaper 122 for shaping the waveform of the rotation signal from the proximity switch 114, and a touch panel type input/display unit 123.

The CPU 115 performs a catching detection process on the basis of the rotation signal supplied from the proximity switch 114 in accordance with the catching detection program stored in the ROM 116 while accessing the RAM 117 and preset value storage memory 118. The detection result is supplied to a printing press control unit 200 through the interface 121.

Figure 9:
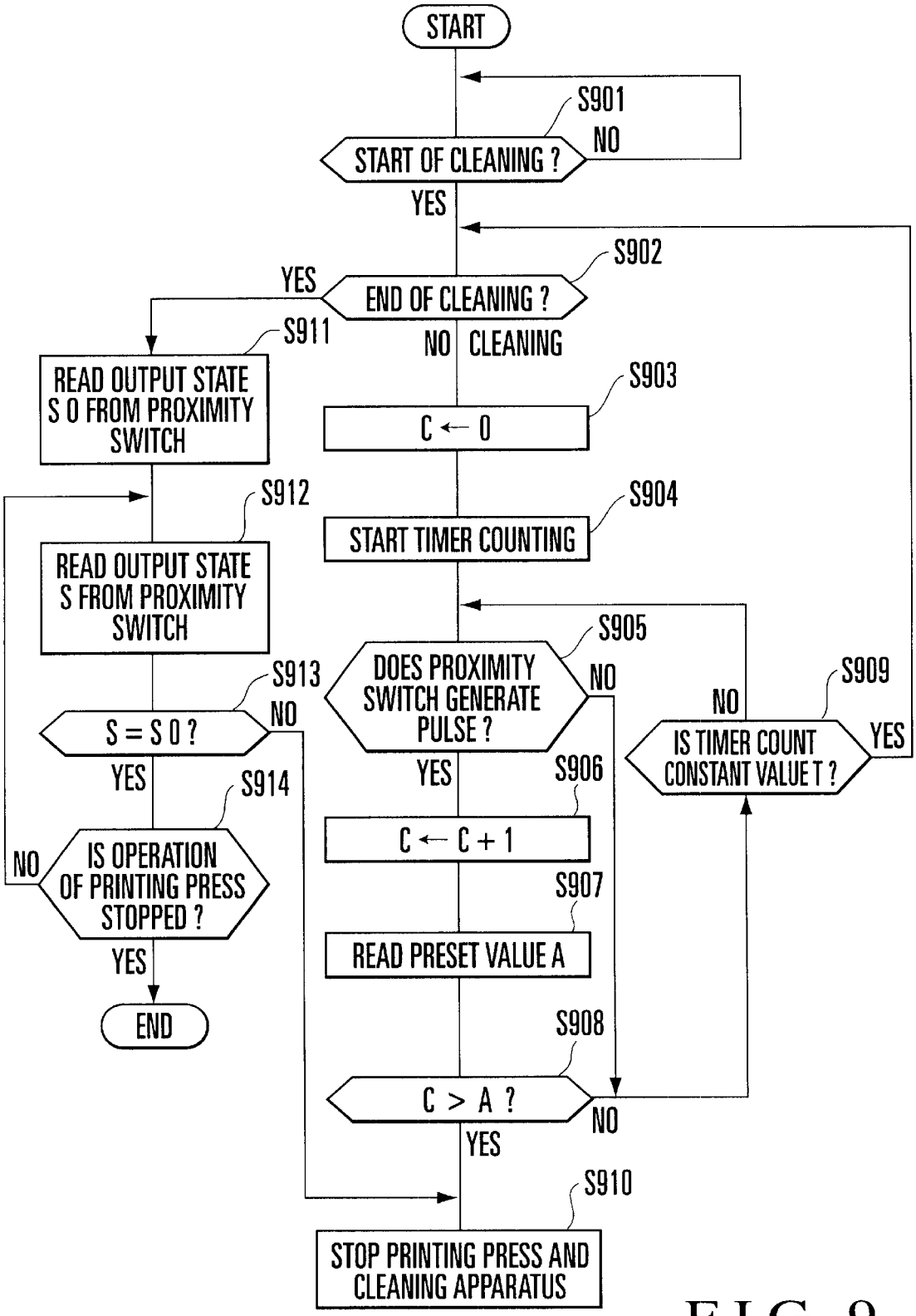
FIG. 9 is a flow chart showing a catching detection process during cleaning and a catching detection process I during non-cleaning, which are performed by the CPU shown in FIG. 7.

A catching detection process during cleaning and a catching detection process I during non-cleaning by the CPU 115 will be described with reference to the flow chart shown in FIG. 9.

[Catching Detection During Cleaning (FIGS. 2A to 2C)]

When cleaning is started, after steps S901 and S902, the CPU 115 sets a count C of the counter to 0 (step S903), and starts the count operation of a soft timer (counter) (step S904). The CPU 115 then checks the output state of the rotation signal supplied from the proximity switch 114 (step S905). If the rotation signal rises to "H" level, i.e., when a pulse is generated, the CPU 115 sets the count C to C+1 (step S906). The CPU 115 then reads out the preset value A from the memory 118 (step S907), and compares the count C with preset value A (step S908).

If the count C is equal to or less than the preset value A, the CPU 115 checks the count of the soft timer which is counting (step S909). If the count of the soft timer does not reach a predetermined value T, the flow returns to step S905. Steps S905 to S909 are repeated in the similar manner. If the count C>preset value A is obtained before the count of the soft timer reaches the predetermined value T, the CPU 115 outputs a catching detection signal indicating that the cleaning cloth 106 is caught to the printing press control unit 200. Upon reception of the catching detection signal, the printing press control unit 200 immediately stops the printing press and cleaning apparatus (step S910). Thus, rotation of the blanket cylinder 101 is stopped, and the take-up operation for the cleaning cloth 106 by the take-up shaft 103 is also stopped.

When it is detected that the cleaning cloth 106 is caught, the CPU 115 supplies a display command to the input/display unit 123 to display that catching has occurred in a specific one of the plurality of printing units. Simultaneously, the CPU 115 drives an alarm unit (not shown) to produce an alarm sound.

Figure 8:
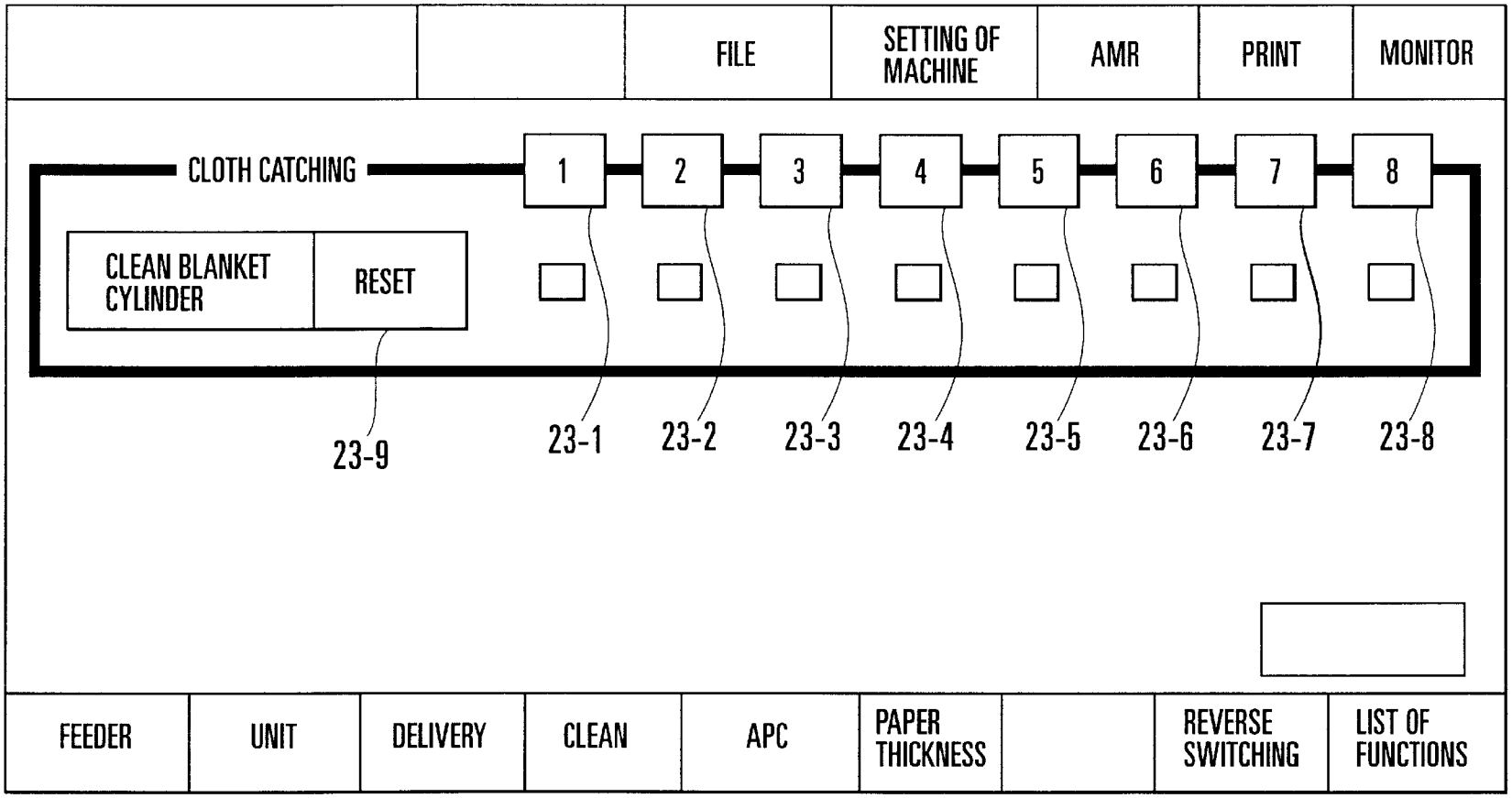
FIG. 8 is a plan view of the display screen of the input/display unit shown in FIG. 1A.

FIG. 8 shows the display screen of the input/display unit 123. Referring to FIG. 8, block lamps 23-1 to 23-8 indicating the eight printing units are turned on to inform a printing unit in which catching has occurred. When either one of the block lamps 23-1 to 23-8 is turned on, neither the printing press can be rotated nor the cleaning apparatus can be operated. When a reset button 23-9 is pressed, the inhibit state is canceled, and the printing press and cleaning apparatus can be operated.

[Catching Detection I During Non-Cleaning (Wait Mode After Cleaning Is Ended) (FIGS. 3A and 3B, and FIGS. 4A and 4B)]

When cleaning is ended in step S902, the CPU 115 reads the output state ("H"/"L" level) of the rotation signal supplied from the proximity switch 114 at the end of cleaning as S0, and stores it in the RAM 117 (step S911). Then, the CPU 115 reads the output state of the rotation signal supplied from the proximity switch 114 again as S (step S912), and compares the output state S with the output state S0 stored in the RAM 117 (step S913).

If the two output states S and S0 coincide, that is, if the output state S0 at the end of cleaning which is read in step S911 coincides with the output state S in the wait mode after cleaning is ended, which is read in step S912, it is checked whether or not the printing press is in operation (step S914). If the printing press is in operation, the flow returns to step S912, and steps S912 to S914 are repeated. During this repetition, if the two output states S and S0 do not coincide in step S913, that is, if the output state of the rotation signal from the proximity switch 114 changes, the flow advances to step S910, and the printing press and cleaning apparatus are stopped.

Figure 10:
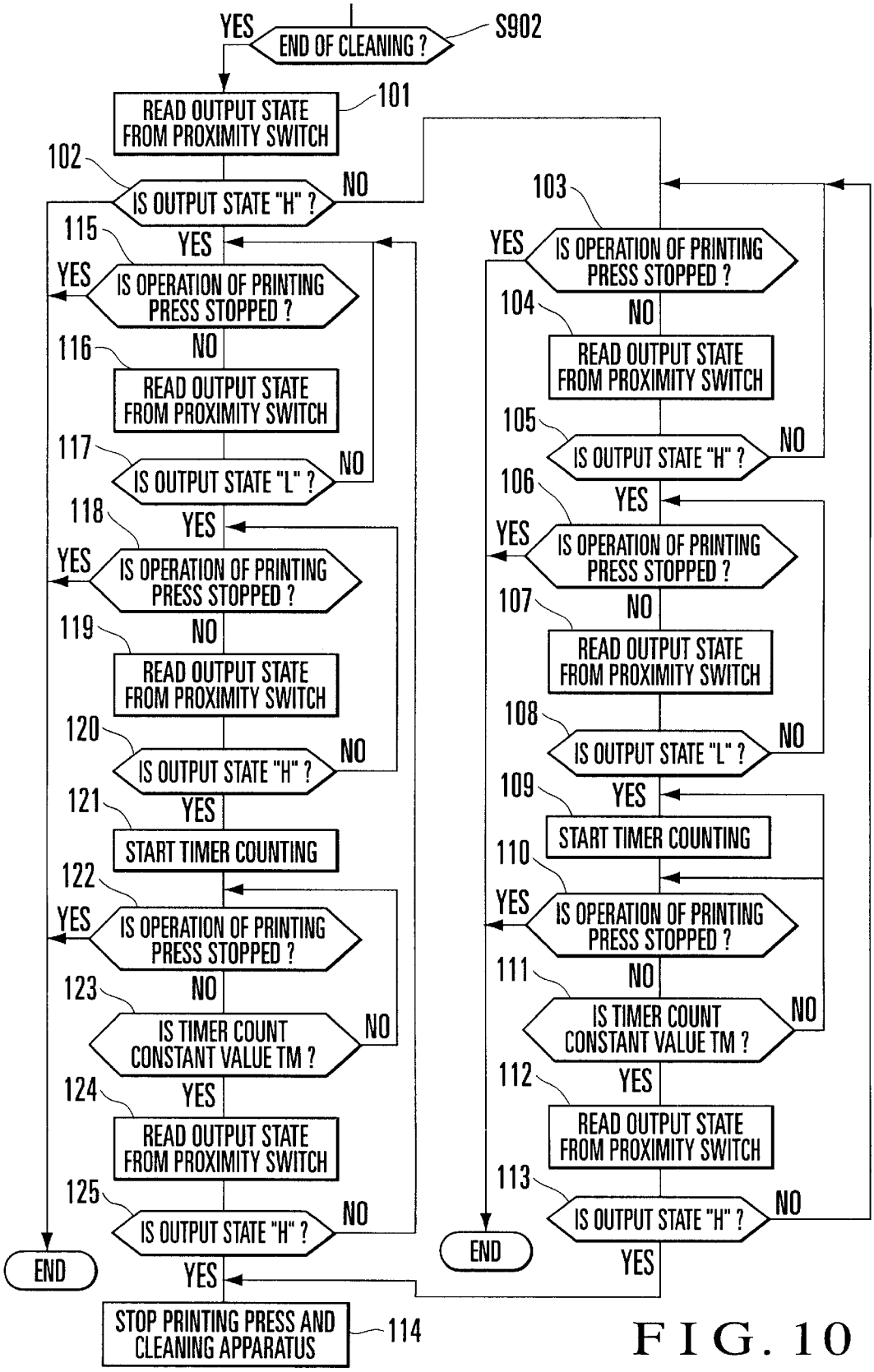
FIG. 10 is a flow chart showing a catching detection process II during non-cleaning by the CPU shown in FIG. 7.
Figure 11:
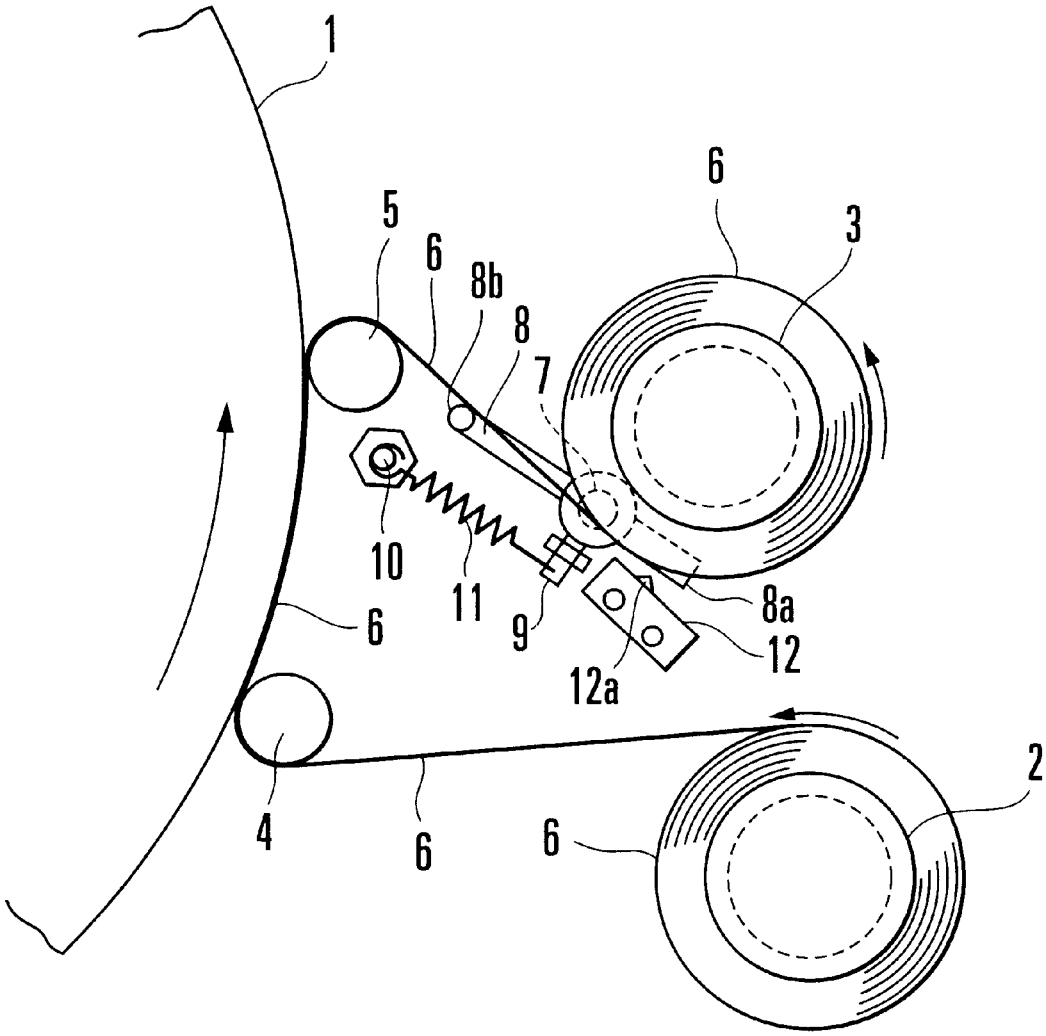
FIG. 11 PRIOR ART
FIG. 11 is a side view showing a conventional cleaning cloth catching detection apparatus.

A catching detection process II during non-cleaning will be described with reference to the flow chart of FIG. 10. FIG. 10 corresponds to steps S911 to S914 of FIG. 9.

[Catching Detection II During Non-Cleaning (Wait Mode After Cleaning Is Ended) (FIGS. 5A to 5C, and FIGS. 6A to 6C)]

When cleaning is ended in step S902, the CPU 115 reads the output state of the rotation signal supplied from the proximity switch 114 at the end of cleaning. The CPU 115 then checks whether the output state of the read rotation signal is "H" level or "L" level (step S102). More specifically, the CPU 115 checks whether the proximity switch 114 is OFF and the supply shaft 102 is stopped, or the proximity switch 114 is ON and the supply shaft 102 is stopped.

If the output state of the rotation signal is "L" level, the CPU 115 confirms in step S103 that the printing press is in operation, and reads the output state of the rotation signal supplied from the proximity switch 114 again (step S104). Then, the CPU 115 checks the read output state (step S105). If the output state is "H" level, i.e., if the output state of the rotation signal has changed from "L" level to "H" level, the CPU 115 performs a process similar to that described above in order to check whether or not the "H"-level output state has changed to "L" level again (steps S106 to S108). If a change to "L" level has occurred, the soft timer starts counting (step S109).

Then, the CPU 115 confirms in step S110 that the printing press is in operation, and checks whether or not the soft timer in counting operation has reached the predetermined value TM (step S111). If YES, the CPU 115 reads the output state of the rotation signal supplied from the proximity switch 114 (step S112), and checks whether or not the output state is "H" level (step S113). If YES, the operations of the printing press and cleaning apparatus are stopped (step S114). If NO, the flow returns to step S103, and the processes of steps S103 to S113 are repeated.

In step S102, if the output state of the rotation signal is "H" level, the CPU 115 confirms in step S115 that the printing press is in operation, and reads the output state of the rotation signal supplied from the proximity switch 114 again (step S116). Then, the CPU 115 checks the read output state (step S117). If the output state is "L" level, i.e., if the output state of the rotation signal has changed from "H" level to "L" level, the CPU 115 performs a process similar to that described above in order to check whether or not the "L"-level output state has changed to "H" level again (steps S118 to S120). If a change to "L" level has occurred, the soft timer starts counting (step S121).

Then, the CPU 115 confirms in step S122 that the printing press is in operation, and checks whether or not the soft timer in counting operation has reached the predetermined value TM (step S123). If YES, the CPU 115 reads the output state of the rotation signal supplied from the proximity switch 114 (step S124), and checks whether or not the output state is "H" level (step S125). If the output state is "H" level, the operations of the printing press and cleaning apparatus are stopped (step S114). If the output state is "L" level, the flow returns to step S115, and the processes of steps S115 to S125 are repeated.

In the above embodiment, the catching detection process during non-cleaning is performed by the method described with reference to FIGS. 3A and 3B and FIGS. 4A and 4B, or FIGS. 5A to 5C and FIGS. 6A to 6C. Alternatively, even during non-cleaning, catching detection may be performed in accordance with the method described with reference to FIG. 2.

In the catching detection process during cleaning described with reference to FIG. 2, the pulse count of the rotation signal and the preset value are constantly compared within the predetermined period of time T. Alternatively, the pulse count of the rotation signal and the preset value may be compared when the predetermined period of time T has elapsed.

In the above embodiment, the rotary member to be cleaned is a blanket cylinder. However, the rotary member is not limited to a blanket cylinder. For example, catching of the cleaning cloth in a printing cylinder other than a blanket cylinder, e.g., an impression cylinder, a transfer cylinder, or a delivery cylinder, and catching of the cleaning cloth in a roller such as a form roller or oscillating roller can be performed in the same manner as that described above.

In the above embodiment, the rotation signal is magnetically obtained by using the proximity switch 114. Alternatively, an optical sensor such as a reflection sensor, or a mechanical sensor such as a limit switch may be used instead. The rotation signal, the output state of which changes in accordance with rotation of the supply shaft 102, is not necessarily a pulse signal, and it suffices as far as the rotation signal is a signal that changes periodically like a triangular wave or sinusoidal wave.

In the above embodiment, the catching detection process by the catching detection unit 100 is performed in a software manner using the CPU 115. Alternatively, this process may be performed with hardware comprised of a counter circuit, a timer circuit, a comparator, and the like.

As has been described above, according to the present invention, even when the tension of the cleaning cloth does not change, the accident that the cleaning cloth is caught in the rotary member as a cleaning target during cleaning can be reliably detected. Even in the wait mode after cleaning is ended, catching of the cleaning cloth can be detected reliably at an early state. In the wait mode after cleaning is ended, catching of the cleaning cloth can be detected without performing erroneous detection due to vibration or impact.

What is claimed is:

1. A cleaning apparatus comprising:

a cleaning web pressed against a rotary member and adapted to clean an outer surface of said rotary member;

a supply shaft around which said cleaning web before cleaning is wound and which rotates in accordance with supply operation of said cleaning web to the outer surface of said rotary member;

a take-up shaft rotatably driven to take up said cleaning web supplied from said supply shaft to the outer surface of said rotary member;

signal output means for outputting a signal corresponding to rotation of said supply shaft; and detection means for detecting that said cleaning web is caught in said rotary member on the basis of a state of the signal output from said signal output means, wherein said signal output means outputs the signal an output state of which changes periodically in accordance with rotation of said supply shaft, wherein said apparatus further comprises storage means for storing the output state of the signal supplied from said signal output means in a state wherein said supply shaft is stopped when cleaning is ended, and said detection means comprises comparing means for comparing the output state of the signal, obtained when cleaning is ended, stored by said storage means with an output state of the signal in a wait mode after cleaning is ended, and outputting a catching detection signal indicating that said cleaning web is caught in the rotary member when the output states differ.

2. An apparatus according to claim 1, wherein said signal output means comprises a detector with a plurality of detecting portions arranged equidistantly on an outer surface thereof and rotatable together with the rotary member, and a detection element for detecting the detecting portions, when said detector rotates, in accordance with either one of magnetic, optical, and mechanical methods, and outputting a rotation signal of said detector.

3. An apparatus according to claim 1, wherein said rotary member is either one of a cylinder and a roller of a printing press.

4. An apparatus according to claim 1, herein the output state stored in the storage means provides an indication of a rotational position of the supply shaft when the supply shaft has stopped at the end of cleaning.

5. A method of detecting catching of a cleaning web in a cleaning apparatus comprising a cleaning web pressed against a rotary member and adapted to clean an outer surface of the rotary member, a take-up shaft for taking up the cleaning web that has cleaned the outer surface of the rotary member, a supply shaft around which the cleaning web to be supplied to the outer surface of the rotary member is wound and which is rotated by take-up operation of the take-up shaft so as to supply the cleaning web, said detection method comprising the steps of:

outputting a signal corresponding to rotation of the supply shaft; and detecting that the cleaning web is caught in the rotary member on the basis of an output state of the signal corresponding to the rotation, wherein the outputting step comprises the step of outputting a signal an output state of which changes periodically in accordance with rotation of the supply shaft, wherein the detecting step comprises the steps of setting, as an origin, a time point at which the output state of the signal supplied from the signal output means, after having changed once, is restored to an initial output state, in the state wherein the supply shaft is stopped when cleaning is ended, and outputting a catching detection signal indicating that the cleaning web is caught in the rotary member on the basis of the output state of the signal obtained at a lapse of a predetermined period of time from the preset origin.

6. A cleaning apparatus comprising:

a cleaning web pressed against a rotary member and adapted to clean an outer surface of said rotary member;

a supply shaft around which said cleaning web before cleaning is wound and which rotates in accordance with supply operation of said cleaning web to the outer surface of said rotary member;

a take-up shaft rotatably driven to take up said cleaning web supplied from said supply shaft to the outer surface of said rotary member;

signal output means for outputting a signal corresponding to rotation of said supply shaft; and detection means for detecting that said cleaning web is caught in said rotary member on the basis of a state of the signal output from said signal output means, wherein said signal output means outputs the signal an output state of which changes periodically in accordance with rotation of said supply shaft, wherein said detection means sets, as an origin, a time point at which the output state of the signal supplied from said signal output means, after having changed once, is restored to an initial output state, in the state wherein said supply shaft is stopped when cleaning is ended, and outputs a catching detection signal indicating that said cleaning web is caught in the rotary member on the basis of the output state of the signal obtained at a lapse of a predetermined period of time from the preset origin.

7. An apparatus according to claim 6, wherein said signal output means comprises a detector with a plurality of detecting portions arranged equidistantly on an outer surface thereof and rotatable together with the rotary member, and a detection element for detecting the detecting portions, when said detector rotates, in accordance with either one of magnetic, optical, and mechanical methods, and outputting a rotation signal of said detector.

8. An apparatus according to claim 6, wherein said rotary member is either one of a cylinder and a roller of a printing press.

9. A method of detecting catching of a cleaning web in a cleaning apparatus comprising a cleaning web pressed against a rotary member and adapted to clean an outer surface of the rotary member, a take-up shaft for taking up the cleaning web that has cleaned the outer surface of the rotary member, a supply shaft around which the cleaning web to be supplied to the outer surface of the rotary member is wound and which is rotated by take-up operation of the take-up shaft so as to supply the cleaning web, said detection method comprising the steps of:

outputting a signal corresponding to rotation of the supply shaft; and detecting that the cleaning web is caught in the rotary member on the basis of an output state of the signal corresponding to the rotation;

wherein the outputting step comprises the step of outputting a signal an output state of which changes periodically in accordance with rotation of the supply shaft, wherein the method further comprises the step of storing the output state of the signal supplied from said signal output means in a state wherein the supply shaft is stopped when cleaning is ended, and the detecting step comprises the steps of comparing the stored output state of the signal, obtained when cleaning is ended, with an output state of the signal in a wait mode after cleaning is ended, and outputting a catching detection signal indicating that the cleaning web is caught in the rotary member when the output states differ.

10. A method according to claim 9, wherein the stored output state provides an indication of a rotation position of the supply shaft when the supply shaft has stopped at the end of cleaning.

* * * * *